US006581619B1

(12) United States Patent
Christiani et al.

(10) Patent No.: US 6,581,619 B1
(45) **Date of Patent: *Jun. 24, 2003**

(54) METHOD AND DEVICE FOR THE SUPPLY OF ELECTRICAL LOADS IN OR ON A PNEUMATIC DEVICE WITH ELECTRICAL POWER ENERGY

(75) Inventors: Peter Christiani, Neuffen (DE); Dieter Staniczek, Aichwald (DE)

(73) Assignee: Festo AG & Co., Esslingen (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/831,395

(22) PCT Filed: Aug. 30, 2000

(86) PCT No.: PCT/EP00/08433

§ 371 (c)(1),
(2), (4) Date: May 7, 2001

(87) PCT Pub. No.: WO01/18405

PCT Pub. Date: Mar. 15, 2001

(30) Foreign Application Priority Data

Sep. 7, 1999 (DE) ..... 199 42 509

(51) Int. Cl.[7] ..... F15B 13/044

(52) U.S. Cl. ..... 137/14; 91/459; 137/596.17; 251/129.04

(58) Field of Search ..... 91/459; 137/14, 137/596.17; 251/129.04

(56) References Cited

U.S. PATENT DOCUMENTS 4,508,014 A * 4/1985 Shoff ..... 137/596.17
5,458,048 A * 10/1995 Hohner ..... 91/459
5,765,589 A 6/1998 Stoll et al.
5,823,088 A * 10/1998 Frisch ..... 91/459
6,463,950 B1 * 10/2002 Staniczek ..... 137/14

FOREIGN PATENT DOCUMENTS

| | | |
|---|---|---|
| DE | 1259272 | 1/1968 |
| DE | 3147339 A1 | 6/1983 |
| DE | 3209189 A1 | 9/1983 |
| DE | 4126403 A1 | 2/1993 |
| DE | 19526459 A1 | 1/1997 |
| EP | 0681090 A2 | 4/1995 |
| GB | 1121829 | 7/1968 |

OTHER PUBLICATIONS

Ashley, Steven, "Turbines on a Dime," *Mechanical Engineering,* 78–81 (1997).

W. D. Loth et al., "Testing of Lower Cost Remote Control System," *Society of Petroleum Engineers, Inc.,* 539–547 (1997).

* cited by examiner

*Primary Examiner*—Gerald A. Michalsky
(74) *Attorney, Agent, or Firm*—Hoffmann & Baron, LLP

(57) ABSTRACT

A method and a device for the supply of electrical loads in or on a pneumatic device with electrical power energy. The pneumatic device is connected by way of a pneumatic line with a source of pressure. The transmission of power energy to the pneumatic device takes place using acoustic waves, microwaves, changes in pressure or a flow of gas in the pneumatic line. Conversion of such transmitted energy into the electrical supply energy occurs in or on the pneumatic device. This means that electrical lines for electrical power supply may be dispensed with and that the transmission of energy takes place only by way of the pneumatic line.

40 Claims, 4 Drawing Sheets

METHOD AND DEVICE FOR THE SUPPLY OF ELECTRICAL LOADS IN OR ON A PNEUMATIC DEVICE WITH ELECTRICAL POWER ENERGY

This application is a national stage application of International Application Number PCT/EP00/08433 filed on Aug. 30, 2000 which claims priority to German Application No. 19942509.4 filed on Sep. 7, 1999.

BACKGROUND OF THE INVENTION

1. Field of the Invention

The invention relates to a method and a device for the supply of electrical loads in or on a pneumatic device with electrical power energy, the pneumatic device being connected by way of a pneumatic line with a source of pressure.

2. Description of the Prior Art

For the control of pneumatic equipment, such as valve arrangements, cylinders, drives and the like, there is on the one hand the requirement for the supply of compressed air by way of a pneumatic line and on the other hand for electrical supply lines for the supply of electrical power energy and of electrical control signals and furthermore possibly return lines for the return of sensor signals. If a plurality of control devices, such as valves, are arranged on one pneumatic device, together with a plurality of sensors, there is a corresponding increase in the number of electrical lines, safety which frequently means that there is a somewhat chaotic arrangement of lines involving high costs for the installation, servicing and repair of such equipment.

The German patent publication 19,526,459 discloses the operation of a bus station valve station comprising a plurality of valves by way of a bus line, by way of which it is also possible for sensor return signals to be passed, but there is here a requirement for additional electrical power lines and the pneumatic line so that in this case the complexity of installation is substantial.

Although the German patent publication 3,147,399 A1, the German patent publication 3,209,189 A1 and the German patent publication 4,126,403 C2 disclose the transmission of control or sensor data ultrasonically through metallic tube supply network, the power energy is not so transmitted and furthermore such method is not applicable to pneumatic lines, which conventionally consist of plastic material

OBJECT AND SUMMARY OF THE INVENTION

Accordingly one object of the present invention is to provide a method and a device by means of which the number of connecting lines leading to a pneumatic device to be controlled may be substantially reduced and installation may be simplified.

The advantage of the device in accordance with the invention is more particularly that using the pneumatic line, which is present in any case it is simultaneously possible for power energy to be transmitted for electrical loads in the pneumatic device so that the no separate lines are required for this purpose. In this case transmission is by way of the gaseous medium or, respectively, conduction is by means of acoustic waves, microwaves, changes in pressure or by means of flow energy of the gaseous medium subject to pressure. For this reason the transmission of energy is possible in the case of conventionally employed plastic lines. The conversion into electrical power energy is performed directly on or in the pneumatic device.

In accordance with a further preferred development the pressure of the gaseous medium in the pneumatic line is utilized for driving a microturbine with an electrical generator, that is to say the flow energy of the gaseous medium under pressure is directly converted in or at the pneumatic device into electrical power energy.

In an alternative design of the invention the acoustic waves or changes in pressure are converted by means of the piezo effect or by capacitive or inductive conversion methods at least partially into electrical power energy in the pneumatic device. For the conversion of the acoustic waves or changes in pressure use is preferably here made of a piezoelectric, capacitive or inductive converter or an oscillating piston arrangement. Such a converter or an oscillating piston arrangement is also preferably provided in a control and/or data receiving means, connected by way of the pneumatic line with the pneumatic conversion of the electrical energy into acoustic waves to be supplied to the pneumatic line or into pressure changes.

It is a advantage for the transmission of control and/or sensor signals between the electronic control and/or data receiving means and the pneumatic device to be by way of the pneumatic line using acoustic signals, microwaves or changes in pressure. For this purpose preferably different frequencies and/or signal sequences and/or modulation and/or pressure pulse sequences are provided, the transmission taking place preferably bidirectionally in order to be able to return sensor signals as well.

For the transmission of such control and sensor signals the control and/or data receiving means and the pneumatic device are preferably provided with at least one first converter for the conversion of electrical signals into acoustic signals or pressure changes and with at least one second converter for the conversion of the acoustic signals or pressure changes into electrical signals. For the bidirectional data transmission both the control and/or data receiving means and also the pneumatic device is provided with a first converter and with a second converter, one first converter and one second converter being designed in the form of a combined bidirectional converter if desired. For this purpose it is possible to employ more particularly piezoelectric or however also inductive or capacitive converters.

The converters for the supply of power energy may be advantageously identical to the converters for the conversion between acoustic signals or pressure changes and electrical control and/or sensor signals, since with the performance of this double function better utilization is possible.

In an alternative design the transmission of control and/or sensor signals between the electronic control and/or data receiving means and the pneumatic device may also takes place in a wireless manner and more particularly by radio or infrared signals or by way of optical guide arranged in or on the pneumatic line or integrated in same in the latter case the control and/or data receiving means and the at least one pneumatic device will preferably be provided respectively with an optical transmitter and/or a optical receiver.

In order to make the supply voltage available continuously, for instance in the case of an energy requirement which is increased for a short time, it is advantageously possible to provide a storage means and more particularly a capacitor or a storage cell, for the storage of the electrical power energy produced in or at the pneumatic device.

A converter which is more especially in the form of a microcomputer in or on the pneumatic device preferably serves for the conversion of the transmitted signals into control signals for at least one control means, as for example a valve, in the pneumatic device and/or for conversion of sensor signals into signals to be transmitted.

The control and/or data receiving means is preferably designed in the form of a bus station connected with a data bus. In this respect a plurality of pneumatic devices may be connected with this bus station by way of pneumatic lines directly or by way of branch lines.

In the case of systems of large size it is possible furthermore for several bus stations to be connected with the data bus, which are respectively connected with at least one pneumatic device.

The at least one converter and the means for making the electrical power energy available are preferably integrated in the pneumatic device so that the arrangements are compact, which for complete installation only have to be connected by way of a single pneumatic line.

Working examples of the invention are illustrated in the drawings and will be explained in the following description in detail

DETAILED DESCRIPTION OF THE PREFERRED EMBODIMENTS

Figure 1:
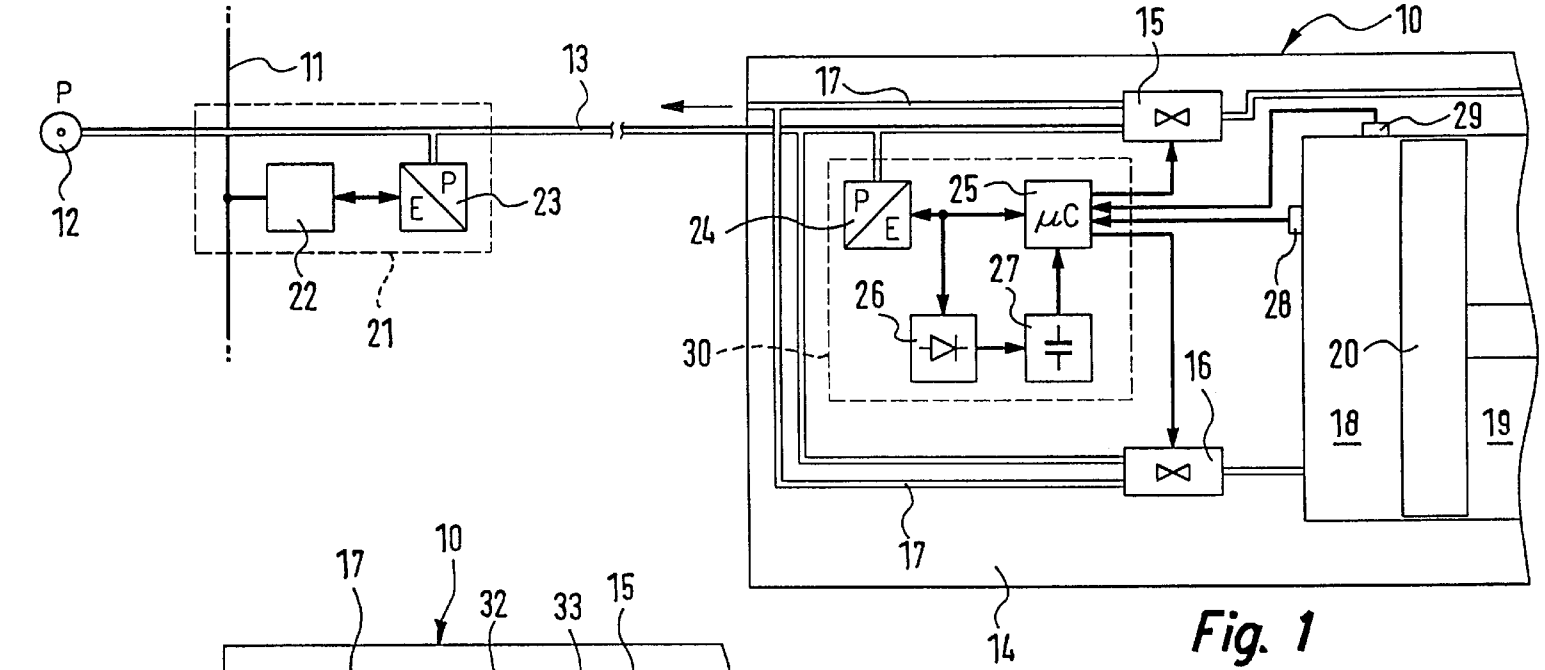
FIG. 1 is a block circuit diagram of a device for the transmission of data between a bus station and a pneumatic cylinder.

In the case of the working example of the invention illustrated in FIG. 1 one pneumatic cylinder 10 is controlled by way of an electrical data bus 11, as for example a field bus. A pneumatic pressure source 12 is connected by way of a pneumatic line 13, consisting for instance of flexible plastic, with the pneumatic cylinder 10. In terminal region of the pneumatic cylinder 20 housing 14 two valves 15 and 16 are respectively integrated, which for instance are in the form of 3/2 way valves. As an alternative to this it would be possible to have a 4/3 way valve. The two valves 15 and 16 are respectively on one side connected with the pneumatic line 13 and a venting duct 17 and on the other side with one of two cylinder chambers 18 and 19 on either side of a moving piston 20.

Electrical control signals of the valves 15 and 16 are supplied by way of the data bus 11 of an electronic control and data receiving means 21. The latter comprises a bus station 22 connected with the data bus 11, such station 22 being connected by way of a bidirectional converter 23 with the pneumatic line 13. The bidirectional converter 23 is for example designed in the form of a piezoelectric converter and converts the supplied electrical signals into the corresponding acoustic signals or sonic oscillations, which are propagated in the gaseous medium in the line 13 and finally reach a corresponding bidirectional converter 24 in the pneumatic cylinder 10, where they are again converted into corresponding signals. The transmission of the data comprised in the electrical signals takes place either by way of different frequencies, which may extend as far as ultrasonic frequencies and be modulated as well, or by way of acoustic signal sequences or, respectively, corresponding changes in pressure or pressure surges in the gaseous medium. As an alternative it is possible for the transmission to also for example take place using microwaves, which are also propagated in the gaseous medium, suitable microwave converters then being necessary.

The electrical signal produced by the bidirectional converter 24 are supplied in the housing 14 to a microcomputer 25, where they are decoded and, dependent of the result of decoding, are converted into control signals for the two valves 15 and 16.

For supplying the microcomputer 25 with power and (directly or indirectly) the valves 15 and 16 a fraction of the electrical signals produced in the converter 24 is rectified in a rectifier arrangement 26 and supplied to a storage means 27, which for example is in the form of a capacitor. The storage means 27 provides a constant supply of current even when actually no signals are arriving by way of the line 13 or there is a current surge or increased energy requirement. In a simpler design it is possible to dispense with a storage means 27.

Having regard the relatively low level of electrical energy available the valves 15 and 16 are for example in the form of valve arrangements with a multiple pilot function, more particularly with the use of piezoelectric valves.

Customarily sensors are arranged on such pneumatic cylinders 10 or on other pneumatic devices, the sensor signals having to be returned or fed back to the control. In the working example a pressure sensor 28 and a position sensor 29 are illustrated to detect the position of the piston. The same are connected with the inputs of the microcomputer 25, where the corresponding sensor signals are digitalized and encoded and in this form supplied to the bidirectional converter 24. Here they are converted in the corresponding acoustic, sonic or pressure signals, and supplied by way of the line 23 to the converter 23, where they are converted back into electrical signals and then supplied to the bus station 22. The corresponding information is digitalized there and supplied by way of the data bus 11 to a master station, not illustrated, which for example may be a PC.

It is of course possible as well, in the case of decentralized intelligence, to further process the sensor signals partly in the microcomputer 25 and/or in the bus station 22 completely or partially or to take them into account for control.

Instead of the microcomputer 25 another decoding and encoding means may of course be used.

The converter 24, the microcomputer 25, the rectifier arrangement 26 and the storage means 27 in the housing 14 of the pneumatic cylinder 10 are collected together in a control and data transmission means 30, which for example may be inserted bodily or may be adapted to be externally mounted.

Data transmission by way of the line 13 in the two opposite directions may for example be within set time windows or slots or in accordance with the master/slave principle. Furthermore the production of the power energy may for example take place in alternation with data transmission in time windows, or however the storage of energy may occur in the storage means 27 respectively in periods, in which there is no transmission of data such transmission being controlled by the microcomputer 25. As an alternative to this it is also possible for a fraction of the electrical signals to be constantly utilized for power supply.

Figure 2:
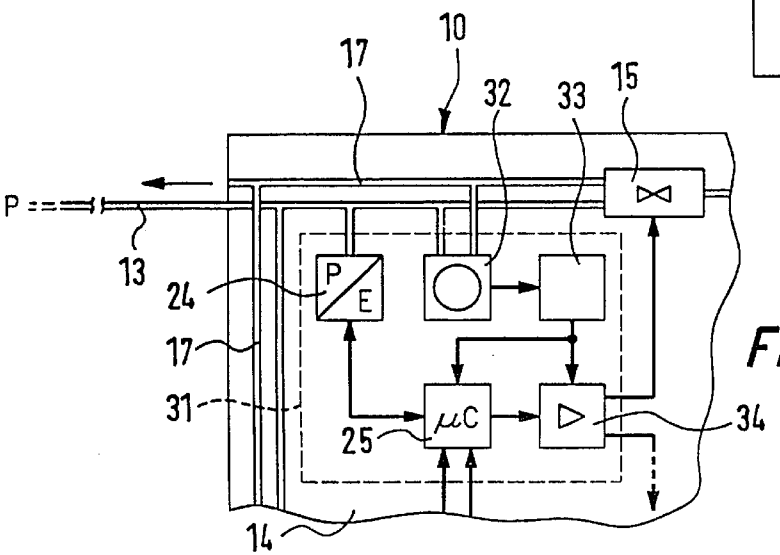
FIG. 2 shows a similar arrangement to that of FIG. 1 in a detailed view with a microturbine for producing electrical power energy in the pneumatic cylinder.

An alternative design of a control and data transmission means 31 is illustrated in FIG. 2, which may be employed instead of the control and data transmission means 30. Identical or functionally equivalent components or assemblies are given the same reference numerals and not described over again. The power energy is here not derived from the transmitted acoustic signal or changes in pressure in the gaseous medium, and instead the pressure in the gaseous medium is employed for driving a microturbine 32 with a microgenerator mounted thereon or integrated in it. Since the line 13 is constantly under pressure, such power energy may be produced at all times so that no storage means is required, though it however may naturally be provided. The electrical energy produced by the microturbine 32 is processed in a power processing circuit 32 and supplies the microcomputer 25 and furthermore the driver stage 34 connected with the output thereof for operation of the valves 15 and 16. Such a driver stage 34 can of course also be provided in the case of the control and data transmission means 30.

Instead of the microturbine 32 it is possible to provide a different micromechanical system for the production of electrical energy, as for example an oscillating piston arrangement.

Figure 3:
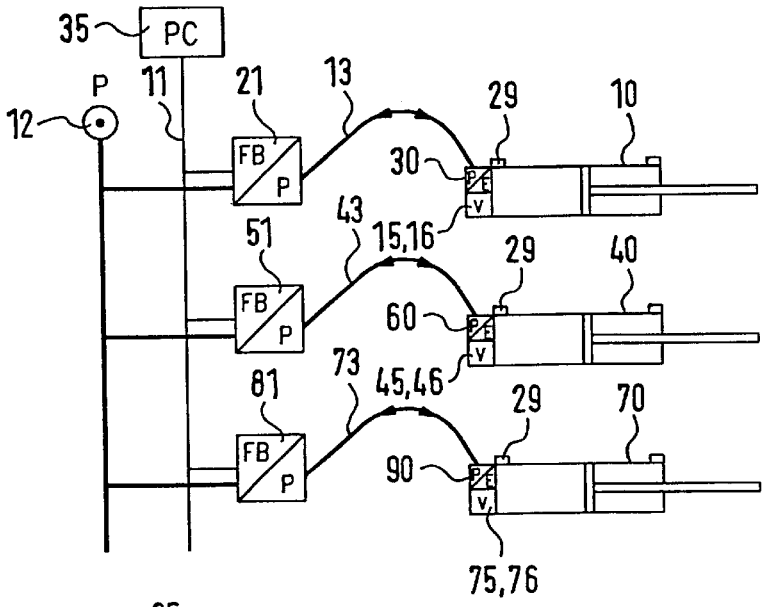
FIG. 3 is a diagrammatic view to show the operation of three pneumatic cylinders by way of three bus stations.

The system illustrated in FIG. 3 serves for the operation of three pneumatic cylinders 10, 40 and 70. The control and data receiving means 21 and the pneumatic cylinder 10 with its control and data transmission means 30 and its valves 15 and 16 are the same as in the arrangement of FIG. 1 (or FIG. 2). Two further control and data receiving means 51 and 81 are correspondingly connected with the data bus 11, which is driven using a master station 35 designed in the form of a PC, such receiving means 51 and 81 being connected by way of the lines 43 and 73, which have corresponding control and data transmission means 60 and 90, with the pneumatic cylinders 40 and 70. The pneumatic cylinders 40 and 70 have valves 45 and 46 and, respectively, 75 and 75, corresponding to the valves 15 and 16. It is in this manner that the overall arrangement may be expanded to any desired extent.

Figure 4:
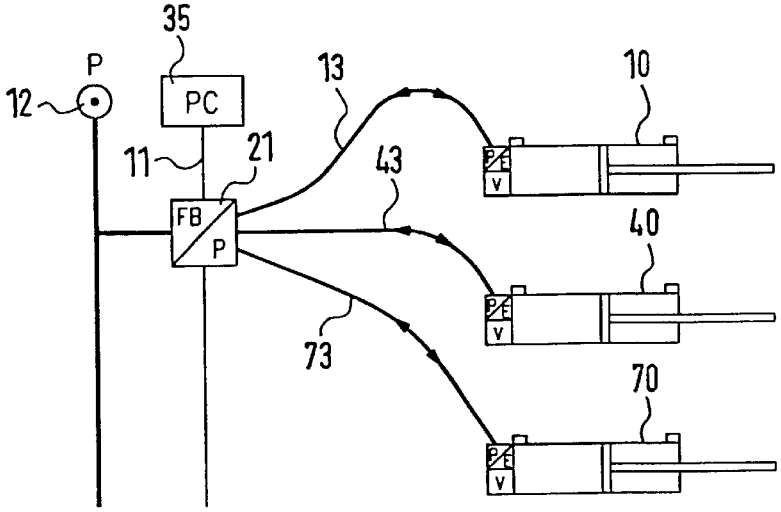
FIG. 4 shows a similar arrangement, in the case of which three pneumatic cylinders are connected with a bus station.
Figure 5:
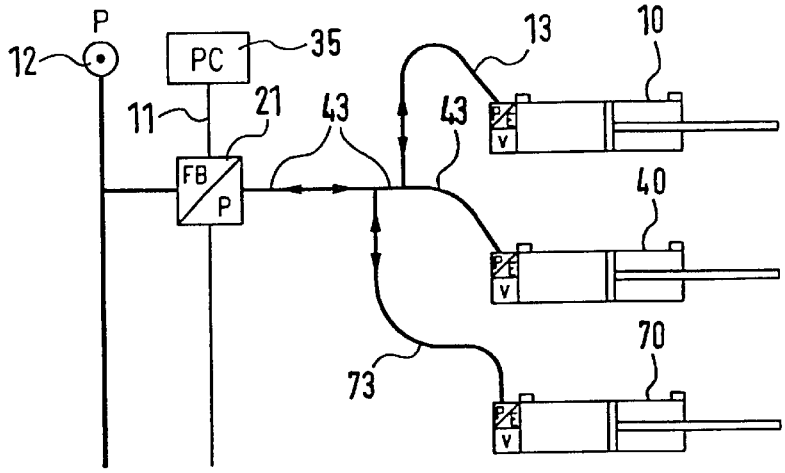
FIG. 5 shows a similar view to that of FIG. 1, in which one connection of a bus station is connected with a bus station by way of FIG. 6 shows a block circuit diagram of a device for the transmission of data between a bus station and a pneumatic cylinder using wireless transmitters.

As an alternative to this it is also possible, as illustrated in FIG. 4, to control all pneumatic cylinders 10, 40 and 70 using a control and data receiving means 21, with which for this purpose the three pneumatic lines 13, 43 and 73 are connected. In this case in accordance with FIG. 4 further control and data receiving means may be connected with the electrical bus 11, and again control a plurality of pneumatic cylinders or other pneumatic device and/or receive the sensor signals therefrom. FIG. 5 shows a possible modification of the system in FIG. 4, because here only the pneumatic line 43 is connected with the control and data receiving means 21, whereas the pneumatic lines 13 and 73 are connected by way of branches or T-junctions with this line 43.

The pneumatic cylinders 10, 40 and 70 employed in the working examples are only given as examples. Instead of these pneumatic cylinders or in addition thereto it is possible to employ other pneumatic devices also, such as a valve islands, pneumatic drives, servicing equipment, or plain sensor arrangements, in the case of which no control signals are supplied.

Figure 6:
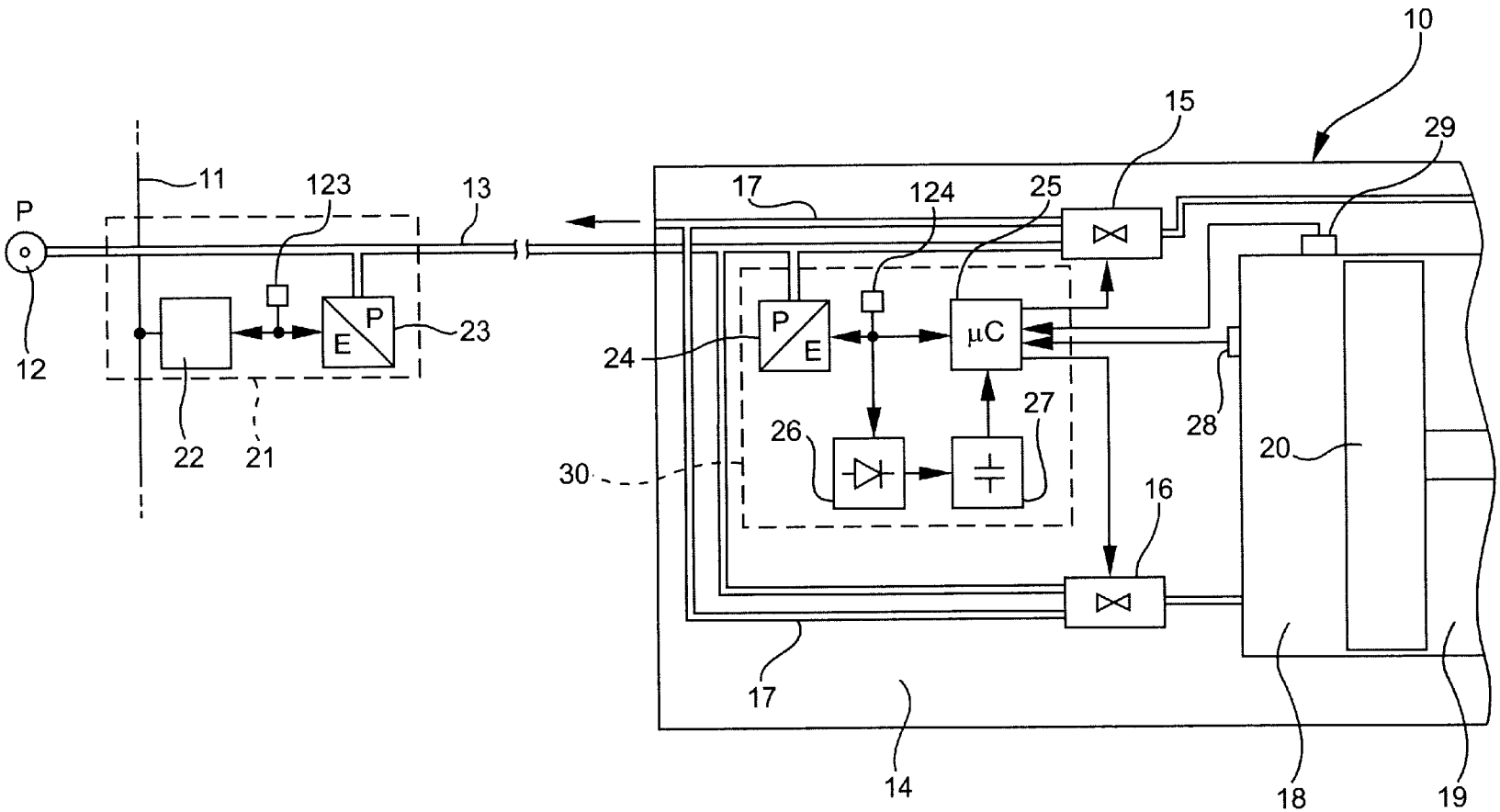
Figure 7:
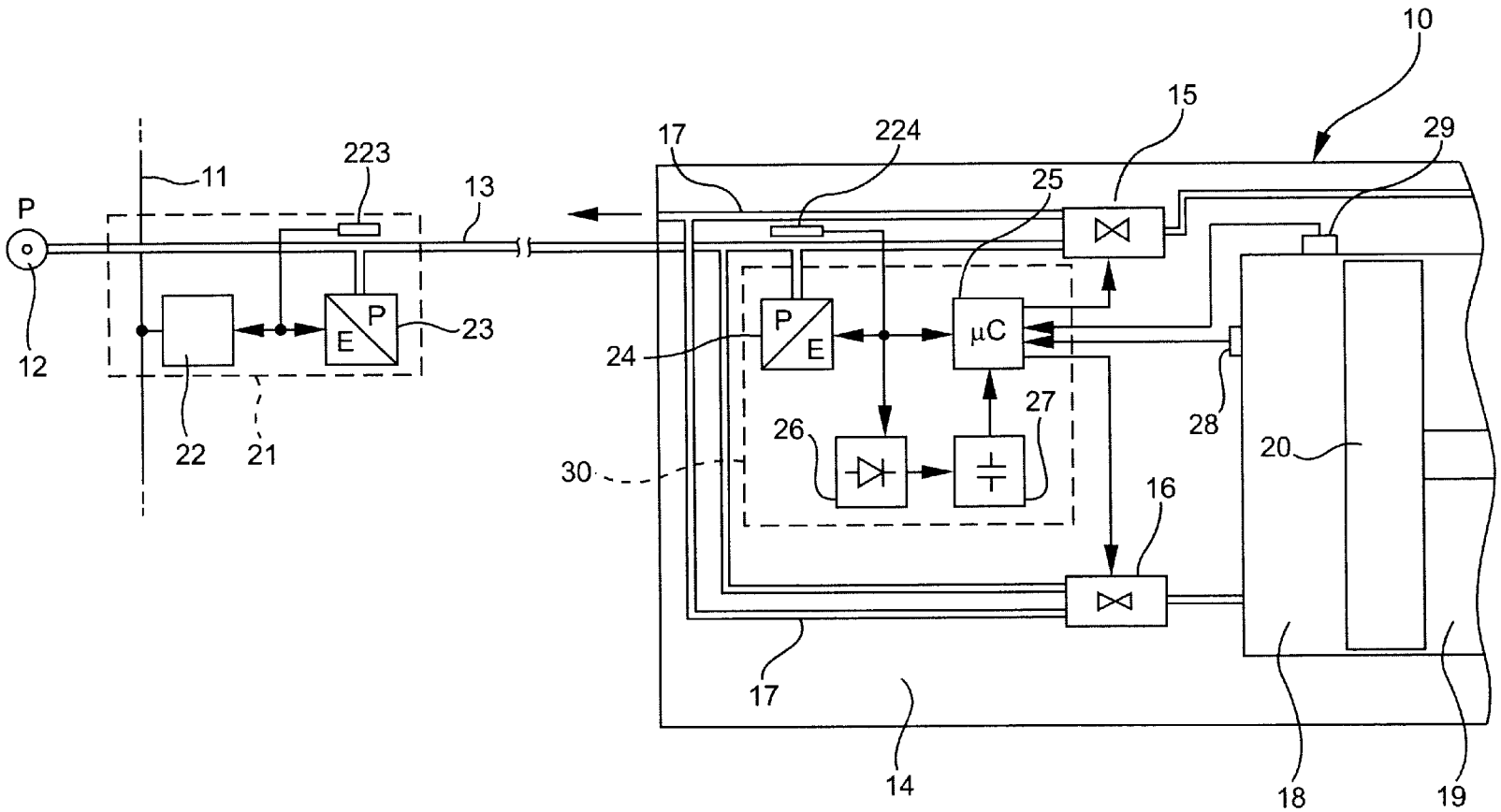
FIG. 7 is a block circuit diagram of a device for the transmission of data between a bus station and a pneumatic cylinder using optical transmitters.

Instead of the data transmission, as described, for transmission of control and/or sensor signals by way of the at least one pneumatic line 13, 43 and 73 such data transmission may also take place in a wireless manner using wireless transmitters 123, 124 as shown in FIG. 6. The wireless transmitters can be configured to use radio or infrared signals. Alternatively, the data transmission may also take place using optical transmitters 223, 224 for transmitting and receiving optical signals. The optical transmitters 223, 224 can be arranged in or on the pneumatic line 13, 43 and 73 or integrated in it. Corresponding transmitters and/or receivers are here comprised in the electronic control and/or data receiving means 21, 51 and 81 and in the pneumatic device 10, 40 and 70. FIG. 7 illustrates the optical transmitters 223, 224 being arranged at the connection junctions of the pneumatic line.

What is claimed is:

1. A method for supplying electrical power to electrical loads associated with a pneumatic device, the pneumatic device being connected by way of a pneumatic line with a source of pressure for maintaining a gaseous medium under pressure and at a flow rate, said method comprising the steps of:

transmitting energy to the pneumatic device through the pneumatic line by at least one of:

acoustic waves;

microwaves;

pressure changes of the gaseous medium; and flow changes of the gaseous medium; and converting said transmitted energy into the electrical power.

2. A method for supplying electrical power as defined in claim 1, wherein a microturbine having an electrical generator converts the pressure of the gaseous medium into the electrical power.

3. A method for supplying electrical power as defined in claim 1, wherein at least one of said acoustic waves and said pressure changes of the gaseous medium are:

transmitted through the pneumatic line; and converted at least partially into the electrical power by a piezoelectric converter.

4. A method for supplying eletrical power as defined in claim 1, wherein at least one of said acoustic waves and said pressure changes of the gaseous medium are:

transmitted through the pneumatic line; and converted at least partially into the electrical power by at least one of capacitive converter and inductive converter.

5. A method for supplying electrical power as defined in claim 1, wherein at least one of said acoustic waves, microwaves and said pressure changes of the gaseous medium are transmitted through the pneumatic line for transmitting at least one of control signals and sensor signals between the pneumatic device and an electronic control and data receiving means.

6. A method for supplying electrical power as defined in claim 5, wherein said transmission of at least one of control signals and sensor signals are provided at a plurality of at least one of frequencies, signal sequences, modulation, and pressure pulse sequences.

7. A method for supplying electrical power as defined in claim 1, wherein at least one of radio and infrared signals are transmitted for transmitting at least one of control signals and sensor signals between the pneumatic device and at least one of an electronic control and data receiving means.

8. A method for supplying electrical power as defined in claim 1, wherein optical transmitters are arranged along the pneumatic line for transmitting optical signals of at least one of control signals and sensor signals between the pneumatic device and an electronic control and data receiving means.

9. A method for supplying electrical power as defined in claim 8, wherein said optical transmitters are attached within the pneumatic line.

10. A method for supplying electrical power as defined in claim 8, wherein said optical transmitters are attached within the pneumatic line.

11. A method for supplying electrical power as defined in claim 1, wherein the transmission occurs bidirectionally.

12. A device for supplying electrical power to electrical loads associated with a pneumatic device, the pneumatic device being connected by way of a pneumatic line with a source of pressure for maintaining a gaseous medium under pressure and at a flow rate, said device comprising:

a conversion means for converting energy transmitted through the pneumatic line into the electrical power, said energy being transmitted by at least one of:
acoustic waves;
microwaves;
pressure changes of the gaseous medium; and
flow changes of the gaseous medium.

13. A device for supplying electrical power as defined in claim 12, wherein the conversion means is provided in the pneumatic device.

14. A device for supplying electrical power as defined in claim 12, wherein the conversion means is provided on the pneumatic device.

15. A device for supplying eletrical power as defined in claim 12, wherein said conversion means is a piezoelectric converter configured to convert at least one of acoustic waves and pressure changes of the gaseous medium.

16. A device for supplying electrical power as defined in claim 15, further comprising:

an electronic control and data receiving means for converting electrical signals into at least one of acoustic waves and pressure changes of the gaseous medium, said electronic control and data receiving means being connected to the pneumatic device through the pneumatic line and including at least one of:
piezoelectric converter;
a capacitive converter;
inductive converter; and
an oscillating piston arrangement.

17. A device for supplying electrical power as defined in claim 12, wherein said conversion means is a capacitive converter configured to convert at least one of acoustic waves and pressure changes of the gaseous medium.

18. A device for supplying electrical power as defined in claim 17, further comprising:

an electronic control and data receiving means for converting electrical signals into at least one of acoustic waves and pressure changes of the gaseous medium, said electronic control and data receiving means being connected to the pneumatic device through the pneumatic line and including at least one of:
a piezoelectric converter;
a capacitive converter;
inductive converter; and
an oscillating piston arrangement.

19. A device for supplying electrical power as defined in claim 12, wherein said conversion means is an inductive converter configured to convert at least one of acoustic waves and pressure changes of the gaseous medium.

20. A device for supplying electrical power as defined in claim 19, further comprising:

an electronic control and data receiving means for converting electrical signals into at least one of acoustic waves and pressure changes of the gaseous medium, said electronic control and data receiving means being connected to the pneumatic device through the pneumatic line and including at least one of:
a piezoelectric converter;
a capacitive converter;
inductive converter; and
an oscillating piston arrangement.

21. A device for supplying electrical power as defined in claim 12, wherein said conversion means is an oscillating piston arrangement configured to convert at least one of acoustic waves and pressure charges of the gaseous medium.

22. A device for supplying electrical power as defined in claim 21, further comprising:

an electronic control and data receiving means for converting electrical signals into at last one of acoustic waves and pressure changes of the gaseous medium, said electronic control and data receiving means being connected to the pneumatic device through the pneumatic line and including at least one of:
a piezoelectric converter;
a capacitive converter;
inductive converter; and
an oscillating piston arrangement.

23. A device for supplying electrical power as defined in claim 12, wherein said conversion means includes a microturbine having an electrical generator for converting the pressure of the gaseous medium into the electrical power.

24. A device for supplying electrical power as defined in claim 12, further comprising a storage means for storing at least a portion of the electrical power produced by said conversion means.

25. A device for supplying electrical power as defined in claim 24, wherein said storage means is a capacitor.

26. A device for supplying electrical power as defined in claim 24, wherein said storage means is a storage cell arrangement.

27. A device for supplying electrical power as defined in claim 12, further comprising:

an electronic control and data receiving means connected to the pneumatic device through the pneumatic line;

at least one first converter for converting electrical signals into at least one of: acoustic signals and pressure changes in the gaseous medium; and at least one second converter for converting at least one of: acoustic signals and pressure changes into electrical signals.

28. A device for supplying electrical power as defined in claim 27, wherein said control and data receiving means is provided with said first converter and said pneumatic device is provided with said second converter.

29. A device for supplying electrical power as defined in claim 27, wherein said control and data receiving means further comprises a second converter and said pneumatic device further comprises a first converter.

30. A device for supplying electrical power as defined in claim 29, wherein at least said first converter and said second converter are combined to form a bidirectional converter.

31. A device for supplying eletrical power as defined in claim 27, wherein said first converter and said second converter are at least one of:

a piezoelectric converter;

a capacitive converter; and an inductive converter.

32. A device for supplying electrical power as defined in claim 27, wherein said first converter and said second converter are identical.

33. A device for supplying electrical power as defined in claim 12, further comprising:

an electronic control and data receiving means for communicating with the pneumatic device; and a data transmission means for transmitting and receiving signals between the pneumatic device and said electronic control and data receiving means, said signals being transmitted by at least one of infrared signals and radio signals.

34. A device for supplying electrical power as defined in claim 12, further comprising:

an electronic control and data receiving means for communicating with the pneumatic device, said electronic control and data receiving means being connected to the pneumatic device through the pneumatic line; and an optical communications means for transmitting and receiving optical signals between the pneumatic device and said electronic control and data receiving means.

35. A device for supplying electrical power as defined in claim 12, wherein the pneumatic device includes:

at least one control means for controlling the pneumatic device; and at least one sensor for monitoring the pneumatic device; and said device further comprises:

a microcomputer for communicating with both the control means and the sensor.

36. A device for supplying electrical power as defined in claim 35, wherein said conversion means and said microcomputer are integrated in the pneumatic device.

37. A device for supplying electrical power as defined in claim 12, further comprising:

an electronic control and data receiving means for converting electrical signals into at least one of acoustic waves and pressure changes of the gaseous medium, said electronic control and data receiving means being connected to the pneumatic device through the pneumatic line and including:

a bus station connected between a data bus and at least one of:

a piezoelectric converter;

a capacitive converter;

an inductive converter; and an oscillating piston arrangement.

38. A device for supplying electrical power as defined in claim 37, wherein a plurality of pneumatic devices are connected by way of a plurality of pneumatic lines with said control and data receiving means.

39. A device for supplying electrical power as defined in claim 37, wherein a plurality of control and data receiving means are connected with said data bus, each of said plurality of control and data receiving means being connected with at least one pneumatic device.

40. A device for supplying electrical power as defined in claim 12, wherein the pneumatic line is manufactured of flexible plastic material.

* * * * *

UNITED STATES PATENT AND TRADEMARK OFFICE

CERTIFICATE OF CORRECTION

PATENT NO. : 6,581,619 B1
DATED : June 24, 2003
INVENTOR(S) : Peter Christiani et al.

It is certified that error appears in the above-identified patent and that said Letters Patent is hereby corrected as shown below:

Column 3,
Line 34, now reads "station by way of" should read -- station by way of branches to three pneumatic cylinders. --

Column 8,
Line 15, now reads "pressure charges" should read -- pressure changes --

Signed and Sealed this

Seventh Day of October, 2003

JAMES E. ROGAN
*Director of the United States Patent and Trademark Office*